United States Patent [19]

Worth

[11] 4,269,603

[45] May 26, 1981

[54] NON-FORMALDEHYDE DURABLE PRESS TEXTILE TREATMENT

[75] Inventor: Daniel L. Worth, Greenwood, S.C.

[73] Assignee: Riegel Textile Corporation, New York, N.Y.

[21] Appl. No.: 36,035

[22] Filed: May 4, 1979

[51] Int. Cl.[3] ..... D06M 13/2; D06M 15/30

[52] U.S. Cl. ..... 8/116.4; 8/115.6; 8/DIG. 1; 8/DIG. 17; 252/8.6; 260/29.2 M; 427/387; 427/393.2

[58] Field of Search ..... 8/116.4, DIG. 17, DIG. 1, 8/115.6; 260/29.2 M; 427/393.2, 387; 252/8.6

[56] References Cited

U.S. PATENT DOCUMENTS

| | | | |
|---|---|---|---|
| 2,412,832 | 12/1946 | Pfeffer et al. | 8/115.6 |
| 2,436,076 | 2/1948 | Pfeffer et al. | 8/116.4 |
| 2,530,175 | 11/1950 | Pfeffer et al. | 8/116.4 |
| 2,541,457 | 2/1951 | Beer | 8/116.4 |
| 2,574,114 | 11/1951 | Lehmann et al. | 8/116.3 |
| 2,622,960 | 12/1952 | Woods et al. | 8/116.4 |
| 2,679,449 | 5/1954 | Schappel | 8/116.4 |
| 3,312,521 | 4/1967 | Stenner | 8/116.4 |
| 3,357,784 | 12/1967 | Kasper | 8/116.4 |
| 3,663,974 | 5/1972 | Watanabe et al. | 8/116.4 |
| 3,979,178 | 9/1976 | Reinhardt et al. | 8/185 |
| 3,989,457 | 11/1976 | Marte | 8/116.4 |
| 4,076,870 | 2/1978 | Yamamoto | 8/116 R |
| 4,116,625 | 9/1978 | Yamamoto | 8/116 R |

FOREIGN PATENT DOCUMENTS

| | | |
|---|---|---|
| 439294 | 6/1934 | United Kingdom . |
| 585679 | 1/1944 | United Kingdom . |
| 586598 | 3/1944 | United Kingdom . |
| 586637 | 3/1944 | United Kingdom . |
| 695703 | 10/1949 | United Kingdom . |
| 744991 | 1/1953 | United Kingdom . |

OTHER PUBLICATIONS

"The Effect of Additives to Thermosetting Resin Baths on Phys. Prop. of the Treated Fabric", American Dyestuff Rep., 11-7-55, 791-794, Garvey.

"The Effect of Silicone Softeners . . . ", Textile Res. J., Jan. 1958, pp. 170-179, Simpson.

"Dialdehydes on Cotton Cellulose Cross-Linkers", Textile Res. J., 3-58, pp. 257-262, Hurwitz et al.

"Crease Resist . . . Polysiloxane Emulsion Treatment", Amer. Dyestuff Rep., 5-28-62, vol. 51, #11, pp. 29-33, Beninate et al.

Derwent Abs. 78810Y/44, Dainippon Ink Chem. J77039-958, "Resin Coating Cellulose Fibers", 10-7-77.

Derwent Abs. 630342 (Belgium) Courtaulds Lts G. Brit. 12236/62, "Modification of Cellulose Fibers".

Derwent Abs. 21548W/13 Toyobo Co. Ltd. J49080388, "Wrinkle-Resistant Cellulose Fiber . . . ", 12-2-72.

Turner et al, "Finishing Cotton/Polyester Knits", vol. 8, #9, pp. 50-53, Sep. 1976, Textile Chemist & Colorist.

"A Water-Rep. Crease-Resist Finish . . . ", Agric. Res. Serv., Aug. 1963, Conner.

"Abrasion Resist DP Cottons", Textile Indust., Sep. 1966, Reeves et al.

"Cross Linked Silicone Fibers in Textile Finishing", Text. Res. Jour., 4-1967, pp. 324-333, Welch et al.

"Crosslinking Cotton Cellulose with Gloxal Reac. Prod.", Amer. Dyestuff Rep., 2-10-69, pp. 27-29, Gonzales et al.

"Formaldehyde's Role in Durable Press Fabrics Seems Likely to Fade", Daily News Record, Monday 2-5-79, Braham Norwich.

"Tris Whistle-Blower Hits Anew This Time it's Formaldehyde", Daily News Record, Wed. 4-4-79, R. Wightman.

*Primary Examiner*—Joseph L. Schofer
*Assistant Examiner*—Herbert J. Lilling
*Attorney, Agent, or Firm*—Bell, Seltzer, Park & Gibson

[57] ABSTRACT

This invention relates to a durable press treatment for textile fabrics containing cellulosic fibers and which is characterized by avoiding the use of formaldehyde and problems associated therewith. The fabric is impregnated with a formaldehyde-free finishing agent containing glyoxal, reactive silicone and a catalyst. The fabric is thereafter dried and the finishing agent is cured to impart durable press properties to the fabric.

19 Claims, 1 Drawing Figure

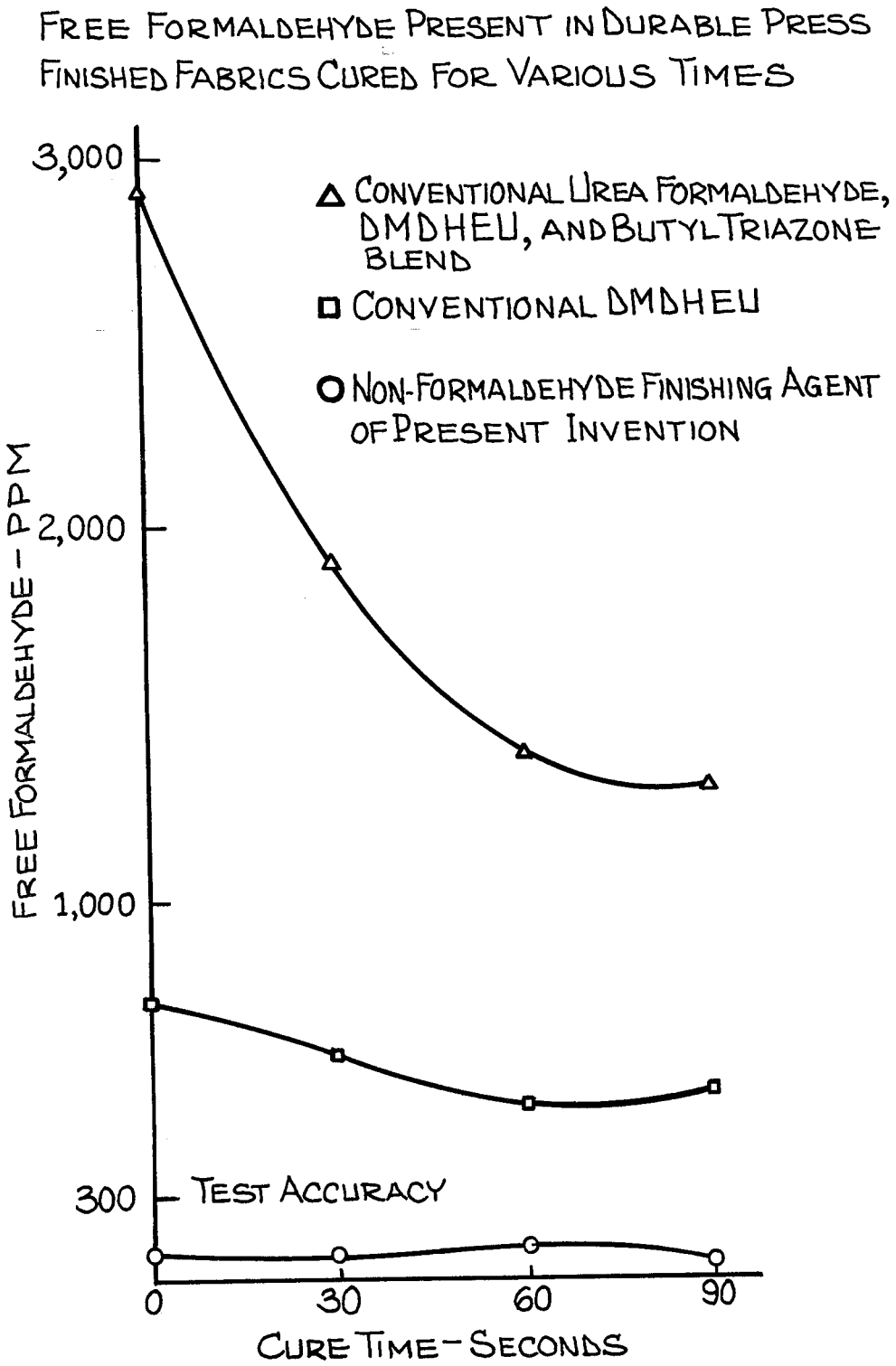
FREE FORMALDEHYDE PRESENT IN DURABLE PRESS FINISHED FABRICS CURED FOR VARIOUS TIMES
3,000
2,000
1,000
300
FREE FORMALDEHYDE - PPM
CONVENTIONAL UREA FORMALDEHYDE, DMDHEU, AND BUTYL TRIAZONE BLEND
CONVENTIONAL DMDHEU
NON-FORMALDEHYDE FINISHING AGENT OF PRESENT INVENTION
TEST ACCURACY
0
30
60
90
CURE TIME - SECONDS

NON-FORMALDEHYDE DURABLE PRESS TEXTILE TREATMENT

FIELD OF THE INVENTION

This invention relates to a non-formaldehyde durable press finish for textile fabrics and to a novel and advantageous process for imparting durable press properties to a textile fabric characterized by avoiding the use of formaldehyde or formaldehyde-based compounds. The present invention also relates to durable press textile fabrics treated with said non-formaldehyde finish.

BACKGROUND OF THE INVENTION

Formaldehyde has been used in the textile industry for a number of years in a variety of applications. Perhaps one of its widest uses is as an ingredient in durable press finishes for fabrics containing cellulosic fibers. Recently, however, there has been increasing concern over safety and health hazards presented by the use of formaldehyde. It has been determined that exposure to formaldehyde on fabrics or in the air can cause allergic reactions in some persons. It has even been suggested that formaldehyde may be a carcinogenic or mutagenic agent.

Because of this concern, efforts are being made in the United States, as well as in foreign countries, to reduce or eliminate formaldehyde usage wherever possible, including textile uses. In the United States, the amount of formaldehyde which can be discharged into waste water streams is limited by governmental regulation, as is the amount of exposure which workers may have to formaldehyde vapors in the air. In Japan, concern over the safety of formaldehyde has led to strict regulations prohibiting any free formaldehyde in apparel for children under two years of age and setting limits on the amount of formaldehyde which may be present in adult apparel. It is anticipated that in the near future, other countries may also enact restrictions or prohibitions on the use of formaldehyde in textile finishing.

Presently, all of the commercial durable press treatments for textile fabrics require formaldehyde or formaldehyde-based compounds. Typically, durable press treatments use methylol derivatives of cyclic ureas or methylol carbamates, of which the following are examples: dimethylol ethylene urea (DMEU), ethyl carbamate, and dimethylol dihydroxyethylene urea (DMDHEU). DMDHEU, sometimes called glyoxal resin, is perhaps the most commonly used durable press finishing agent and is formed by reacting urea, formaldehyde and glyoxal. The methylol group ($—CH_2—OH$) of all of these durable press agents is formed by formaldehyde and is the group that cross-links with cellulose to give durable press properties. There is no way to prevent some formaldehyde from being released when this cross-linking (curing) occurs. In addition, some free formaldehyde usually remains in the cured fabric. If the residual free formaldehyde is to be removed from the fabric, an afterwashing operation is required, but even this is not totally effective.

Intensive efforts are being made both in the United States and abroad to develop a durable press treatment which eliminates formaldehyde or formaldehyde-based compounds and at least one non-formaldehyde durable press treatment has recently been proposed. Recent U.S. Pat. No. 4,116,625 discloses a non-formaldehyde durable press finish based on imidazoline derivatives combined with acrylic or methacrylic glycidyl containing polymers. It is reported, however, that this process is more expensive and less effective than processes based on formaldehyde, and requires powerful acid catalysts which are of questionable safety.

Therefore, at the present time no commercially acceptable alternatives to formaldehyde-based durable press finishes have been introduced, and formaldehyde is regarded as a "necessary evil" in durable press finishes. The primary approach to the formaldehyde problem has thus been to attempt to reduce formaldehyde levels. Various approaches have been employed, such as varying the catalyst systems used or reducing the amount of formaldehyde-based resin in the finish by employing a resin extender, such as silicone. These approaches are not very effective, however, and the formaldehyde levels in the finishing plant and in the fabric remain undesirably high.

SUMMARY OF THE INVENTION

The present invention provides a durable press treatment which has succeeded in eliminating any dependence on the use of formaldehyde or formaldehyde-generating chemicals, and thus avoids the attendant problems and hazards of formaldehyde in the finishing operation and in the finished fabric. The present invention achieves durable press fabric properties which are comparable, if not superior, to those obtained by conventional formaldehyde-based durable press treatments. The treatment method can be carried out at a competitive cost and on the same apparatus which is used for conventional formaldehyde-based durable press treatments.

The formaldehyde-free durable press finishing agent of the present invention contains as fiber treating agents a mixture of two readily available materials, glyoxal and reactive silicone. Each of these materials has been previously used in textile finishing applications. However, so far as applicant is aware these two materials have never been used in combination with one another in a process for imparting durable press properties to a fabric.

Reactive silicone, for example, is commercially sold as a softener and resin extender for use in combination with formaldehyde-based durable press resins to reduce the amount of resin required while also imparting desirable hand properties to the finished fabric. The silicone is thus used as an additive to a resin which itself has the capability of imparting durable press properties to the fabric. By way of example, the effect of silicone on resin treated cellulosic fabrics is considered by Simpson in *Textile Research Journal,* February 1958.

Glyoxal, as noted earlier, has previously been used as an ingredient in a formaldehyde-based durable press resin. Additionally, several early patents disclose the use of glyoxal for dimensionally stabilizing or shrink-proofing fabrics made of regenerated cellulose, as for example the Pfeiffer, Jr., et al U.S. Pat. Nos. 2,412,832; 2,436,076 and 2,530,175.

It is recognized by those knowledgeable in the field of textile finishing that although glyoxal has utility in some applications for shrink-proofing, it is ineffective in imparting durable press properties to a fabric. Additionally, it is also known that the use of glyoxal has undesirable side effects and results in severe loss of fabric strength.

It has been discovered in accordance with the present invention that although reactive silicone and glyoxal are each ineffective by themselves as a durable press agent, their combined use as fiber treating agents imparts effective durable press properties to a fabric and, most significantly, for the first time makes it possible and practical to provide durable press properties in a fabric without the use of formaldehyde or formaldehyde-generating chemicals.

DESCRIPTION OF THE DRAWING

The drawing is a graph comparing the amount of free formaldehyde present in fabrics treated with two conventional formaldehyde-based durable press resins and with the non-formaldehyde durable press finishing agent of the present invention. Free formaldehyde (in parts per million) is plotted against curing time in seconds.

The amount of free formaldehyde in the fabric was determined by the Sealed Jar Method (AATCC Test Method 112-1978). This test method is intended to detect free formaldehyde over a range from about 300 ppm, which is undetectable by the nose, to about 3500 ppm, which is very odoriferous.

The curve indicated by triangles, which shows the highest amount of free formaldehyde, is a commercially available resin which is a blend of urea formaldehyde, DMDHEU, and butyl triazone. The curve indicated by squares is a commercially available DMDHEU (glyoxal formaldehyde-based resin) product. The curve indicated by circles is the non-formaldehyde durable press finishing agent of the present invention. As seen in the graph, the small level of free formaldehyde measured in the non-formaldehyde samples is well below the minimum sensitivity of the current standard test method for formaldehyde detection. Work directed toward a more accurate test method for determination of very small amounts of formaldehyde in a fabric is continuing.

Durable press fabrics produced in accordance with the present invention are thus essentially free of formaldehyde. Any formaldehyde which might be found in the fabric would be attributable either to impurities present in the glyoxal or other reactants, degradation of the glyoxal, or pick-up from formaldehyde vapors present in the air. There is no purposeful addition of formaldehyde to the finish formulation.

DETAILED DESCRIPTION OF THE INVENTION

The non-formaldehyde durable press treatment of the present invention is applicable to textile fabrics which are formed at least partially of cellulosic fibers, such as cotton and synthetic fiber blend fabrics as well as 100% cotton fabrics.

The finishing agent may be applied to the fabric in the same manner that conventional formaldehyde-based durable press finishes are applied, such as for example by impregnation with an aqueous bath or foam of the finishing agent. The fabric is then dried and thereafter cured by heating.

The invention is applicable for producing both precured and postcure fabrics. As is well known, precured fabrics are cured during the finishing operation, usually immediately following drying of the impregnated fabric. In postcure fabrics, the fabric is impregnated with the finishing agent and dried, but the curing is performed at a later time, usually after the fabric has been cut and formed into garments.

In a preferred method of application, the fabric is impregnated by padding with an aqueous bath of the non-formaldehyde finishing agent to obtain a wet pick-up of about 45 to about 100 percent by weight. The fabric is then dried on a tenter frame operating at an elevated temperature of up to about 300° F. If the fabric is to be postcured, it is dried to a moisture content of about five to ten percent and then removed from the tenter frame. If the fabric is to be precured, curing may be carried out on the tenter frame immediately following drying by heating the fabric in a curing chamber at a temperature of about 350°–400° F. for up to about two minutes until sufficiently cured. Following curing, the fabric may be subjected to an after-washing operation if desired.

Glyoxal for use in the present invention is available in commercial quantities as an aqueous solution, usually about 40 percent concentration.

The reactive silicone materials which may be suitably employed in the present invention are available from various manufacturers. These materials are designed and sold for use as softening agents and durable press resin extenders for textile finishing applications. They generally are available as stable reactive organosilicone emulsions which are readily dilutable with water. Manufacturers sometimes recommend that the reactive silicone material be used in conjunction with cross-linking additives, such as silane, but when employed pursuant to the present invention, the cross-linking additive is not essential. Suitable results have been observed both with and without use of the recommended cross-linking additives. Illustrative, but non-limiting examples of suitable reactive silicones include General Electric Silicone Softener/Resin Extender SM2129, Dow Corning 1111 Silicone Emulsion, Union Carbide Y-9224 Silicone Emulsion and General Electric Silicone Softener/Resin Extender XM-124-5557.

The glyoxal and reactive silicone fiber treating agents are applied to the fabric in the presence of a catalyst. Catalysts suitable for use with conventional formaldehyde-based durable press resins may also be used with the non-formaldehyde finishing agent of the present invention. Conventional durable press catalysts include metal salt catalysts, latent catalysts, and acid or acid salt catalysts. Illustrative, but non-limiting examples of such catalysts include the following: zinc fluoborate, ammonium chloride, magnesium chloride, ammonium phosphate, ammonium sulfate, amine hydrochlorides, and zinc nitrate.

A number of the conventional durable press catalysts, when used with the non-formaldehyde durable press finishing agent of the present invention, have been found to cause discoloration or change of shade in the fabric when allowed to remain on the fabric following curing. However, these catalysts may be suitably used with the present invention with no adverse effect when the fabric is subjected to an after-washing operation following curing, since the catalysts are removed from the fabric by the after-washing treatment.

It has been found, however, that the undesirable after effects produced by some of the conventional durable press catalysts may be avoided by using as a catalyst in the present invention a metal sulfate salt. Particularly suitable as a catalyst is a metal sulfate blend which comprises a mixture of aluminum sulfate and magnesium sulfate in substantially equal proportions.

The formaldehyde-free finishing agent of the present invention may optionally include small amounts of a wetting agent for facilitating the wetting and penetration of the finishing agent into the fabric. Particularly suitable as wetting agents are nonionic surfactants such as ethoxylated decyl alcohols, ethoxylated nonyl alcohols, ethoxylated secondary alcohols, and alkylaryl polyether alcohols. Illustrative but non-limiting examples of suitable commercially available wetting agents are: Triton X-100, a product of Rohm and Haas, and MYKON NRW, available from Sun Chemical Corporation.

Other conventional textile finishing modifiers or additives may be incorporated in the formulation, if desired, including hand builders or hand modifiers such as polyvinyl acetate or acrylic resins, softeners, soil release agents, etc.

The glyoxal and reactive silicone fiber treating agents have been found to be effective in providing durable press properties at very low concentration levels on the fabric. In some instances, for example, acceptable durable press properties have been achieved with as little as one-third of one percent glyoxal or as little as one-fourth of one percent reactive silicone, by weight based on the dry weight of the fabric. However, concentrations somewhat higher than this are usually preferred in order to obtain consistently good results. The upper limit on the amount of glyoxal and silicone is primarily a practical limit dictated by economics. Fabric properties and durable press performance are not significantly improved by increasing the concentration levels of the fiber treating agents above the preferred levels, but no adverse effects on durable press properties are observed.

The preferred concentration levels of the fiber treating agents vary depending upon the fiber content, the weight and construction of the fabric, and on other factors. Fiber blend fabrics, such as cotton and polyester fiber blends, for example, will require a lower concentration level of fiber treating agents than fabrics formed wholly of cotton fibers to achieve comparable durable press properties.

For the range of fiber contents, fabric styles, weights and constructions which are normally encountered, it has been found desirable to apply to the fabric a glyoxal concentration within the range of about one to about eight percent and a reactive silicone concentration within the range of about one-third of one percent to about one percent, by weight based on the dry weight of the fabric.

For synthetic fiber and cotton blend fabrics containing up to about fifty percent cotton fibers, a concentration of about one and one-half percent to about three percent glyoxal and about one-third percent to about two-thirds percent reactive silicone is preferred. For fabrics formed wholly or predominantly of cotton fibers, a higher glyoxal concentration of about three percent to about seven percent is preferred, with the silicone concentration preferably remaining within the range of about one-third percent to about two-thirds percent, by weight based on the dry weight of the fabric.

In the aqueous finishing bath, the concentration of the fiber treating agents, catalyst and other ingredients may vary depending upon a number of factors, such as the method of application, wet pick-up achieved, desired concentration on fabric, etc. Preferably, however, these materials are present in proportions by weight generally as follows:

glyoxal (solids basis): 100 parts
catalyst (active solids basis): 5–40 parts
reactive silicone (solids basis): 3–75 parts
wetting agent (wet basis): up to about 15 parts
other additives, modifiers, etc. (solids basis): up to about 200 parts A particularly preferred formulation is as follows:

glyoxal (solids basis): 100 parts
catalyst (active solids basis): 12–23 parts
reactive silicone (solids basis): 18–43 parts
wetting agent (wet basis): up to about 15 parts
other additives, modifiers, etc. (solids basis): up to about 200 parts The invention is further illustrated by the following examples in which all parts and percentages are by weight unless otherwise indicated. These non-limiting examples are illustrative of certain embodiments of the invention and are designed to teach those skilled in the art how to practice the invention and the best mode contemplated for carrying out the invention.

EXAMPLE 1

A non-formaldehyde durable press finish bath was formulated by diluting about 110 lbs. of commercial glyoxal (40 percent aqueous solution) with about 50 gallons of water, and to this diluted solution adding three pounds of an ethoxylated decyl alcohol nonionic surfactant (MYKON NRW), 27.5 pounds of metal sulfate blend catalyst (a 50/50 mixture of aluminum sulfate and magnesium sulfate at a 30 percent concentration), 46 pounds of reactive silicone (General Electric Silicone Softener/Resin Extender XM-124-5557) containing 25 percent by weight active solids, and 20 pounds of polyvinyl acetate hand builder (SEYCO REZ B-47 produced by AZS Chemical Company of Atlanta, Georgia). Water was then added to make a total of 150 gallons of mix. This finishing bath formulation was piped to a three-roll padder and a 65/35 polyester/cotton blend twill weave fabric weighing about 7.3 ounces per square yard was directed through the padder where it was immersed in the finishing bath and squeezed to remove excessive finish and to provide a wet pick-up of about 55 percent. After the finishing bath formulation was applied, the fabric was dried on a tenter frame operating at a temperature of about 250°–300° F., and then directed through a curing oven at a temperature of about 375°–400° F. for about one minute to cure the finishing agent.

The impregnation of the fabric with the finishing bath provided a weight percent concentration of solids on the dried fabric calculated to be as follows:

wetting agent: 0.034%
glyoxal: 1.84%
metal sulfate blend catalyst: 0.34%
reactive silicone: 0.48%
polyvinyl acetate: 0.46%

The amount of formaldehyde was checked at the exhaust of the tenter frame during the run, but no formaldehyde was detected. The finished fabric was also tested and a free formaldehyde content of 150 ppm was measured, which as noted earlier is below the minimum sensitivity of the test method.

Physical properties of the fabric were measured using standard AATCC test methods. Durable press properties were determined by rating the fabric smoothness appearance after five home washings on a scale of 1 to 5 with reference to standard fabric smoothness test specimens (AATCC Test Method 124-1978). The following results were observed:

| | | |
|---|---|---|
| breaking strength, lbs. | W. | 236 |
| breaking strengh, lbs. | F. | 127 |
| tearing strength, gms. | W. | 6400 |
| tearing strength, gms. | F. | 5450 |
| finished weight, oz./sq. yd. | | 7.5 |
| construction | W. | 86 |
| construction | F. | 48 |
| fabric appearance | | 4 |
| fastness to: | washing - stain | 3–4 |
| | washing - color chg. | 4 |
| | chl. blch. - stain | 3–4 |
| | chl. blch. - color chg. | 3–4 |
| | light | 4 |
| pH of fabric | | 3.6 |
| ppm formaldehyde | | 150 |

The fabric physical properties were fully satisfactory. The fabric smoothness appearance rating of 4 represents acceptable durable press performance.

EXAMPLE 2

A 5.3 ounce twill weave shirting fabric containing 65 percent polyester fibers and 35 percent cotton fibers was directed through a padder and impregnated with the following formulation:

glyoxal (40%): 95 lbs.
sulfate blend catalyst (50% aluminum sulfate/50% magnesium sulfate): 25 lbs.
anionic surfactant (HIT Wet WR): 3 lbs.
G. E. Silicone XM-124-5557: 46 lbs.
polyvinyl acetate: 22.5 lbs.
acetic acid: 2 lbs.
water: to make 150 gallons The fabric was squeezed to a 50 percent wet pick-up, thereafter dried on a tenter frame, and then directed through a curing oven at a temperature of 375° to 400° F. for about one minute. Fabric physical properties and appearance were measured using standard AATCC test methods and the test results are shown in Table 1.

For comparison, the same fabric was treated under similar conditions with a conventional DMDHEU durable press resin, and the test results are also shown in Table 1.

TABLE 1

| | | Non-Formaldehyde Finish | DMDHEU Control |
|---|---|---|---|
| breaking strength, lbs. | W. | 188 | 192 |
| breaking strength, lbs. | F. | 72 | 75 |
| tearing strength, gms. | W. | 5800 | 4000 |
| tearing strength, gms. | F. | 3800 | 2650 |
| finished weight, ozs./sq. yd. | | 5.3 | 5.3 |
| construction | W. | 125 | 128 |
| construction | F. | 49 | 50 |
| fabric appearance | | 4 | 4 |
| fastness to: | washing - stain | 3 | 3 |
| | color change | 4 | 4 |
| | chl. blch. - stain | 3 | 3 |
| | chl. blch. - col. chg. | 4 | 4 |
| | light | 4 | 4 |
| ppm formaldehyde | | 75 | 300 |
| pH of fabric | | 5.0 | — |

The cost of the non-formaldehyde finish was comparable to the DMDHEU resin. The physical properties were comparable to or better than the DMDHEU control, and the fabric smoothness appearance ratings were the same. This test showed the non-formaldehyde durable press finish to be an acceptable alternative to the formaldehyde-based DMDHEU resin.

EXAMPLES 3 to 6

Samples of a 7.2 ounce/square yard fabric (65 percent polyester/35 percent cotton) were impregnated with various finish formulations, and were dried and cured under similar conditions. Comparisons of the durable press properties were made by rating the fabric appearance after five home washings (AATCC Test Method 124-1978 and/or by measuring the crease recovery angle in the warp and filling direction (Monsanto test).

EXAMPLE 3

GLYOXAL PLUS REACTIVE SILICONE

Tests were made varying the type and amount of reactive silicone in the finish, with the following results:

| | % solids applied (by weight) | | |
|---|---|---|---|
| wetting agent | .034 | .034 | .034 |
| glyoxal | 1.59 | 1.59 | 1.59 |
| sulfate blend catalyst | .31 | .31 | .31 |
| G. E. Silicone XM-124-5557 | .48 | — | — |
| Dow Corning 1111 silicone emulsion | — | .67 | .48 |
| Dow Corning T4-0149 additive | — | — | .14 |
| polyvinyl acetate | .46 | .46 | — |
| | Test Results | | |
| appearance after 5 HW | 4 | 4 | 4 |
| crease recovery angle, W + F, as received | 298 | 310 | 310 |

EXAMPLE 4

SILICONE VARIATIONS

Tests were made using reactive silicone without glyoxal and using glyoxal with various levels of silicone. The following results were observed:

| | % solids applied | | | |
|---|---|---|---|---|
| wetting agent | .034 | .034 | .034 | .034 |
| glyoxal | — | 1.59 | 1.59 | 1.59 |
| sulfate blend catalyst | .31 | .31 | .31 | .31 |
| G. E. Silicone XM-124-5557 | .48 | — | .34 | .48 |
| polyvinyl acetate | .28 | .28 | .46 | .46 |
| | Test Results | | | |
| crease recovery angle, W + F, as received | 220 | 275 | 307 | 298 |

While the crease recovery was undesirably low when glyoxal alone or silicone alone was used, a dramatic improvement in crease recovery was observed when the two were used in combination. Increasing the amount of silicone from 0.34 to 0.48 percent provided no additional improvement in crease recovery for this fabric.

EXAMPLE 5

GLYOXAL VARIATIONS

Runs with various levels of glyoxal ranging from 0.28 percent to 2.75 percent were made on a 5.1 ounce and 7.2 ounce fabric, with the following exemplary results:

| | % solids applied | | | | | |
|---|---|---|---|---|---|---|
| fabric weight, ozs. (65% polyester/ 35% cotton) | 5.1 | 5.1 | 7.2 | 5.1 | 7.2 | 7.2 |
| wetting agent | .034 | .034 | .034 | .034 | .034 | .034 |
| glyoxal | .28 | .32 | .38 | 2.75 | 2.75 | 4.4 |
| sulfate blend catalyst | .054 | .061 | .073 | .54 | .54 | .31 |
| G. E. Silicone XM-124-5557 | .67 | — | — | — | — | .48 |
| Dow Corning T4-0149 additive | — | .14 | .14 | .14 | .14 | — |
| Dow Corning 1111 emulsion | — | .48 | .48 | .48 | .48 | — |
| polyvinyl acetate | .42 | .42 | .42 | .48 | .48 | .51 |
| | Test Results | | | | | |
| appearance after 5 HW | 3.5 | 3 | 4 | 4 | 4 | 4 |
| crease recovery angle W + F, as received | 271 | 302 | 273 | 319 | 309 | 290 |

Good results were observed with as low as 0.32 percent glyoxal on the 5.1 ounce fabric, but higher levels of glyoxal were required before consistently good results were observed. Increasing the glyoxal concentration from 2.75 percent to 4.4 percent showed no additional improvement in appearance or crease recovery. The upper limitation on the amount of glyoxal which may be used thus appears to be merely an economic limitation.

EXAMPLE 6

CATALYSTS

On 7.2 ounce fabric (65 percent polyester/35 percent cotton):

| | % solids applied | | | | |
|---|---|---|---|---|---|
| wetting agent | .034 | .034 | .034 | .034 | .034 |
| glyoxal | 1.88 | 1.88 | 1.59 | 1.59 | 1.59 |
| sulfate blend catalyst | .37 | — | .31 | .22 | .15 |
| magnesium dihydrogen phosphate catalyst | — | .34 | — | — | — |
| G. E. Silicone XM-124-5557 | .48 | .48 | .48 | .48 | .48 |
| polyvinyl acetate | .49 | — | .46 | | |
| | Test Results | | | | |
| appearance after 5 HW | 4 | 4 | 4 | 4 | 4 |
| crease recovery angle, W + F, as received | 293 | 310 | 298 | 338 | 303 |

Good fabric appearance and crease angle were observed with both the sulfate blend catalyst and the phosphate catalyst, even as low as 0.15 percent catalyst. However, slight fabric discoloration was observed with the phosphate catalyst.

EXAMPLE 7

POSTCURE

Examples 3 to 6 above were precured, i.e. the fabric was fully cured at 350°–400° F. after drying. The example below was postcured, meaning that the fabric was dried only to about 5 percent moisture content and then later cured at 325°–350° F. for several minutes. Cutters would buy this non-cured fabric and make it into garments before pressing and curing.

| | % solids applied |
|---|---|
| wetting agent | .034 |
| glyoxal | 1.59 |
| sulfate catalyst | .31 |
| G. E. Silicone XM-124-5557 | .48 |
| polyvinyl acetate | .46 |
| | Test Results |
| appearance after 5 HW | 4 |
| crease recovery angle, W + F, after curing | 290 |
| crease appearance after 5 HW | 5 |

EXAMPLE 8

Samples of a 9 ounce/square yard twill weave fabric containing 50 percent polyester fibers and 50 percent cotton fibers were impregnated with various finish formulations and were dried and cured under similar conditions. Comparisons of the durable press properties were made by rating the fabric appearance after five home washings (AATCC Test Method 124-178) and by measuring the crease angle in the warp and filling direction (Monsanto test). The following results were observed:

| | % solids applied | | | | | |
|---|---|---|---|---|---|---|
| wetting agent | .034 | .034 | .034 | .034 | .034 | .034 |
| glyoxal | 1.84 | 2.30 | 2.76 | 3.22 | 3.68 | 4.15 |
| sulfate catalyst | .31 | .31 | .31 | .31 | .31 | .31 |
| silicone | .48 | .48 | .48 | .48 | .48 | .48 |
| polyvinyl acetate | .46 | .46 | .46 | .46 | .46 | .46 |
| | Test Results | | | | | |
| appearance after 5 HW | 4 | 4 | 4 | 4+ | 4 | 4 |
| crease recovery angle W + F, as received | 281 | 289 | 294 | 301 | 285 | 296 |

Acceptable durable press qualities were observed as low as 1.84 percent glyoxal. Performance improved slightly as the glyoxal concentration was increased to 2.30, but further increases did not produce significant improvement.

EXAMPLE 9

Samples of a 10 ounce/square yard twill weave fabric (100 percent cotton) were impregnated with various finish formulations and were dried, cured, and tested as in Example 8. The following results were observed:

| | % solids applied | | |
|---|---|---|---|
| wetting agent | .034 | .034 | .034 |
| glyoxal | 3.68 | 4.61 | 6.45 |
| sulfate catalyst | .31 | .31 | .31 |
| silicone | .48 | .48 | .48 |
| polyvinyl acetate | .46 | .46 | .46 |

-continued

| | Test Results | | |
|---|---|---|---|
| appearance after 5 HW | 4− | 3+ | 4 |
| crease recovery angle, W + F, as received | 281 | 288 | 294 |

The sample containing 6.45 percent glyoxal exhibited fully acceptable durable press properties.

EXAMPLE 10

To a 40 percent aqueous glyoxal solution, sodium hydroxide (25 percent aqueous solution) was added dropwise while stirring until the glyoxal was brought from an initial pH of about 2.6 to a substantially neutral pH of about 7. To this solution was added magnesium dihydrogen phosphate catalyst, polyvinyl acetate, a wetting agent, reactive silicone, and water, to produce a finishing bath formulation of the composition shown below. This formulation was applied to a 65/35 polyester/cotton blend fabric at a 55 percent pick-up and the fabric was dried and cured to a concentration on the fabric as shown below (percent active solids by weight):

| | in bath | on fabric |
|---|---|---|
| wetting agent | .062 | .034 |
| glyoxal | 3.42 | 1.88 |
| phosphate catalyst | .62 | .34 |
| reactive silicone | .88 | .48 |
| polyvinyl acetate | 1.67 | .92 |
| The sample was tested for fabric appearance, crease angle and pH with the following results: | | |
| crease recovery angle | 286 | |
| fabric appearance | 4 | |
| fabric pH | 4.6 | |

From the foregoing description and examples it will thus be seen that the present invention has provided a practical and effective durable press finish formulation and treatment method which has succeeded in eliminating any dependence on the use of formaldehyde or formaldehyde generating chemicals, and thus avoids the attendant problems and hazards of formaldehyde in the finishing operation and in the finished fabric.

While the invention has been described in considerable detail with reference to certain preferred embodiments thereof, it will be understood that variations and modifications may be made within the spirit and scope of the invention as described above and as defined in the appended claims.

What is claimed is:

1. A process for imparting durable press properties to a textile fabric formed at least partially of cellulosic fibers and characterized by avoiding the use of formaldehyde and problems associated therewith, said method comprising impregnating the textile fabric with a formaldehyde-free finishing agent comprising glyoxal, reactive silicone and a catalyst, and thereafter drying the fabric and curing the finishing agent to impart durable press properties to the fabric.

2. A process according to claim 1 wherein the impregnating of the fabric is achieved by padding and the drying of the fabric is carried out at elevated temperature on a tenter frame.

3. A process according to claim 2 wherein the curing of the fabric is also carried out at elevated temperatures on the tenter frame and is performed immediately following drying.

4. A process according to claim 2 wherein the curing of the fabric is performed by heating the fabric after the fabric has been cut and formed into a garment.

5. A process according to claim 1 wherein the formaldehyde-free finishing agent contains about 3 to 75 parts by weight reactive silicone solids per 100 parts by weight glyoxal solids.

6. A process according to claim 1 wherein the impregnating of the fabric is carried out so as to provide a pick-up of about 1% to about 8% glyoxal and about ⅓% to about 1% silicone, by weight, based on the dry weight of the fabric.

7. A process according to claim 1 wherein said catalyst comprises a metal sulfate salt.

8. A process for imparting durable press properties to a textile fabric formed at least partially of cellulosic fibers and characterized by avoiding the use of formaldehyde and problems associated therewith, said method comprising impregnating the fabric with a formaldehyde-free finishing agent containing glyoxal, about 3 to 75 parts reactive silicone, and about 5 to 40 parts durable press catalyst, by weight, solids basis, per 100 parts by weight glyoxal solids, drying the impregnated fabric, and heating the fabric to effect curing of the finishing agent and to impart durable press properties to the fabric.

9. A process for imparting durable press properties to a textile fabric formed at least partially of cellulosic fibers and characterized by avoiding the use of formaldehyde and problems associated therewith, said method comprising impregnating the fabric with a formaldehyde-free finishing agent which contains as fiber treating agents a mixture of glyoxal and reactive silicone and which also contains a durable press catalyst, and obtaining on the fabric a glyoxal concentration within the range of about 1% to about 8% and a reactive silicone concentration within the range of about ⅓% to about 1% by weight based on the dry weight of the fabric, drying the impregnated fabric, and heating the fabric to effect curing of the finishing agent and to impart durable press properties to the fabric.

10. A durable press textile fabric produced in accordance with the process set forth in any one of claims 1, 8 or 9.

11. A cured durable press textile fabric formed at least partially of cellulosic fibers, said fabric containing glyoxal and reactive silicone as fiber treating agents for said cellulosic fibers and imparting durable press properties to the fabric.

12. A treated textile fabric formed at least partially of cellulosic fibers and adapted for being cured by heating to impart durable press properties to the fabric but without the use of formaldehyde and problems associated therewith, said textile fabric containing an uncured formaldehyde-free finishing agent including as fiber treating agents a mixture of glyoxal and reactive silicone.

13. A textile fabric according to claim 11 or 12 containing from about 1 to about 8% glyoxal and from about ⅓% to 1% reactive silicone, by weight based on the dry weight of the fabric.

14. A non-formaldehyde finishing agent for imparting durable press properties to a textile fabric formed at least partially of cellulosic fibers, said finishing agent comprising a formaldehyde-free aqueous composition containing glyoxal, reactive silicone, and a durable press catalyst.

15. A finishing agent according to claim 14 also containing a wetting agent.

16. A finishing agent according to claim 14 also containing a hand modifier.

17. A finishing agent according to claim 14 wherein said catalyst comprises a metal sulfate salt.

18. A finishing agent according to claim 17 wherein said metal sulfate salt catalyst comprises a mixture of aluminum sulfate and magnesium sulfate.

19. A finishing agent according to claim 14 containing about 3 to 75 parts reactive silicone and about 5 to 40 parts durable press catalyst, by weight, solids basis, per 100 parts by weight glyoxal solids.

* * * * *